US005508670A

United States Patent [19]

Mantzouridis et al.

[11] Patent Number: 5,508,670

[45] Date of Patent: Apr. 16, 1996

[54] TRIP INTERLOCK ASSEMBLY FOR A CIRCUIT BREAKER

[75] Inventors: Petros K. Mantzouridis, Irwin; Phillip L. Ulerich, Pittsburgh, both of Pa.

[73] Assignee: Eaton Corporation, Cleveland, Ohio

[21] Appl. No.: 345,680

[22] Filed: Nov. 28, 1994

[51] Int. Cl.[6] ..... H01H 9/00

[52] U.S. Cl. ..... 335/172; 335/35; 335/8

[58] Field of Search ..... 335/8–10, 167–176, 335/35, 23–25

[56] References Cited

U.S. PATENT DOCUMENTS

| | | | |
|---|---|---|---|
| 3,963,780 | 2/1976 | Hennemann | 335/35 |
| 4,489,295 | 12/1984 | Altenhof, Jr. et al. | 335/20 |
| 4,638,277 | 1/1987 | Thomas et al. | 335/190 |
| 4,639,701 | 1/1987 | Shimp | 335/173 |
| 4,642,430 | 2/1987 | Tedesco | 200/153 |
| 4,656,444 | 4/1987 | McKee et al. | 335/16 |
| 4,679,018 | 7/1987 | McKee et al. | 335/167 |
| 4,691,182 | 9/1987 | Mrenna et al. | 335/176 |
| 4,698,606 | 10/1987 | Mrenna et al. | 335/45 |
| 4,725,800 | 2/1988 | Grunert et al. | 335/38 |
| 4,963,846 | 10/1990 | Grunert et al. | 335/42 |

*Primary Examiner*—Lincoln Donovan
*Attorney, Agent, or Firm*—Martin J. Moran

[57] ABSTRACT

A modular trip unit for automatically tripping a switch of a circuit breaker when the circuit breaker is being removed from its panel mounting when the circuit breaker has not been manually overridden. The modular trip unit is an integral part of the circuit breaker and includes a trip interlock assembly integrally mounted in the modular trip unit. The trip interlock assembly comprises a spring biased slider extending through and out of the housing of the trip unit, and an actuator in engagement with the slider. The actuator engages a first cam surface of a trip bar and a catching member of a latching assembly is engaged by a lip member on a second cam surface of the trip bar. When the circuit breaker is being mounted on the panel mounting, the slider is forced inwardly thereby compressing a spring associated with the slider, and the slider causes the actuator to rotate in a first direction. When the circuit breaker is removed from the panel mounting, the slider is forced outwardly pulling the actuator with it and causing the actuator to rotate in a second direction and the lip member to disengage from the catching member of the latching assembly. The latching assembly becomes disengaged from the cradle of the operating mechanism for the circuit breaker, effecting separation of the main contacts and interruption of the flow of current through the circuit breaker.

19 Claims, 7 Drawing Sheets

TRIP INTERLOCK ASSEMBLY FOR A CIRCUIT BREAKER

BACKGROUND OF THE INVENTION

1. Field of the Invention

This invention relates to molded case circuit breakers, and more particularly to a mechanical trip interlock assembly for automatically tripping the circuit breaker when the circuit breaker is removed or lifted away from its panel mounting when a manual override for tripping the circuit breaker has not been operated.

2. Description of the Prior Art

Circuit breakers are generally well-known in the art. Examples of molded case circuit breakers are disclosed in U.S. Pat. Nos. 4,489,295; 4,638,277; 4,642,430; 4,656,444; 4,679,018; and 4,963,846. Circuit breakers are used to protect electrical circuitry from damage due to an overcurrent condition, such as an overload and relatively high level short circuit conditions.

Certain types of molded case circuit breakers have mounted within their housing a modular trip unit which includes a trigger or latching assembly, which under normal conditions latches a cradle operatively coupled to one or more main contacts. Actuation of the modular trip unit unlatches the cradle which causes the contacts to separate, which, in effect, interrupts the flow of current through the circuit breaker from the line side to the load side.

Molded case circuit breakers include at least one pair of separable contacts which generally may be operated manually by way of a handle disposed on the outside of the case or automatically in response to an overcurrent condition. When the circuit breaker is on, the movable contact assembly being in contact with the stationary contact assembly, provides a flow of current between the line and load terminals. When the circuit breaker trips or is switched off, the movable contact assembly is moved away from the stationary contact assembly, thus, interrupting the flow of current from the line terminals to the load terminals.

An electronic trip unit may be provided for interrupting the current flow, and is generally operated automatically or manually by way of a pushbutton. When the pushbutton is pressed, a plunger associated with the pushbutton causes a trip bar to rotate to trip the circuit breaker.

In an automatic mode of operation for the electronic trip unit, the contact assemblies for all poles are tripped together by the electronic trip unit which operates a mechanical operating mechanism. The electronic trip unit is provided with current sensors which respond to an overcurrent condition. When an overcurrent condition is sensed, the current transformers provide a signal to the electronic circuitry within the electronic trip unit to actuate the operating mechanism to cause the main contacts of the poles to be separated.

A circuit breaker also includes a cradle having latch and reset surfaces for latching and resetting the operating mechanism. A molded case circuit breaker further includes a molded base and a coextensive cover. A centrally located aperture is provided in the cover for receiving an operating handle to allow the circuit breaker to be operated manually. The handle is comprised of an arcuate shaped base portion with a radially extending hand portion.

A common type of circuit breaker has a handle which moves linearly between an on and an off position. The handle is connected to the movable contacts of the circuit breaker through a spring powered, over center toggle device which trips the contacts open and moves the handle to an intermediate position in response to certain overcurrent conditions.

Sometimes it is necessary to remove a circuit breaker from its panel mounting after it has been placed in service. For example, the circuit breaker may need to be removed for servicing or maintenance. Additionally, the circuit breaker may have to be removed and replaced with another circuit breaker with a different current rating due to a change in the load requirements.

Circuit breakers with plug in type rear terminations may be removed from the circuit breaker panel by unfastening the circuit breaker and pulling it outwardly from the panel. Such action will disconnect the circuit breaker load side and line side terminations from the corresponding receptacles on the circuit breaker panel. If the circuit breaker is on and is supplying electrical power to a load, electrical current will be flowing through the circuit breaker line side and load side terminations and corresponding receptacles on the circuit breaker panel. Should the circuit breaker be removed from its panel mounting while electrical current is flowing therethrough the electrical circuit would be broken between the terminations on the circuit breaker and the corresponding receptacles on the panel causing an arc to be drawn therebetween.

In some of the known circuit breakers it is incumbent on the operator to manually trip the circuit breaker before removing it from the panel. This is done either by a trip button, or if there is no trip button, the operator manually turns the handle to the "off" positioning.

In circuit breakers such as disclosed in Grunert, et al., U.S. Pat. No. 4,963,846, assigned to Westinghouse Electric Corporation, there is a device for automatically tripping the circuit breaker prior to its being removed from the panel. This device is referred to as "a trip interlock assembly," which trips the circuit breaker any time the circuit breaker is removed from its panel mounting. This trip interlock assembly is adapted to be disposed adjacent a load side terminal and cooperates with the circuit tripping means. In one embodiment, the trip interlock assembly includes a housing and a spring-loaded actuation arm disposed generally perpendicular to the circuit breaker panel surface. The actuation arm is formed with a cam surface which cooperates with a trip pin, reciprocally mounted with respect to the circuit breaker tripping means. The trip pin acts as a cam follower and rides along the cam surface formed in the actuation arm. When the actuation arm is in an inward position indicating that the circuit breaker is mounted against a panel, the trip pin will not actuate the tripping means. However, when the circuit breaker is removed from the panel, the actuation arm, under the influence of a biasing spring moves outwardly, which, in turn, causes the cam surface on the actuation arm to move outwardly. This action causes the trip pin to move inwardly with respect to the trip unit and actuate the tripping means, which, in turn, trips the circuit breaker.

In an alternative embodiment of the invention of U.S. Pat. No. 4,963,846, the trip interlock assembly includes a bell crank interlock with a reciprocally mounted plunger which actuates an armature in the tripping means directly instead of by way of the trip pin any time the circuit breaker is removed from its panel housing.

A disadvantage of the trip interlock assembly of the prior art such as that of this U.S. Pat. No. 4,963,846 is the fact that its design requires it to be disposed adjacent to either a load or a line side terminal for its mounting and interconnection to the circuit breaker.

There remains a need for a modular tripping unit which has a trip interlock assembly which is built inside a housing of a modular trip unit.

SUMMARY OF THE INVENTION

The present invention obviates or ameliorates the aforementioned shortcomings of the prior art by providing an improved design for a trip interlock assembly which is built into a modular trip unit and which is automatically actuated to unlatch the operating mechanism of the circuit breaker from the modular trip unit upon removal of the circuit breaker from its panel mounting.

This improved design for a trip interlock assembly is encompassed within the modular housing and uses a spring biased trip bar mounted in the modular housing.

The trip interlock assembly of the present invention employs a spring biased slider member which has a probe end protruding out of the back of the modular housing of the trip unit and a hook element at its end opposite to the probe end for engaging a tab member of an actuator. The actuator extends out of the top of the modular housing and is pivotally mounted to an actuator latching mechanism located on top of the modular housing. The actuator has an end portion which engages a first cam surface of the trip bar.

When the circuit breaker is being mounted onto its panel mounting, the probe end of the slider member engages a surface of the panel mounting, forcing the slider member into the housing and the actuator to rotate in a direction away from the slider member with a lower portion of the actuator being spaced away from the first cam surface of the trip bar.

Upon removal of the circuit breaker from its panel mounting, the probe end of the slider member is forced farther out of the back of the modular housing. This sliding action of the slider member causes the slider member to pull the actuator in an opposite direction toward the slider member causing the lower portion of the actuator to engage the first cam surface of the trip bar and to rotate the trip bar. A second cam surface of the trip bar engaging a plunger member of the latching assembly causes the latching assembly to disengage the cradle of the breaker assembly, thereby opening the contacts. That is, the cradle is released from the latching assembly thereby moving the operating mechanism into a trip positioning where the electrical contacts are separated and the current flow is interrupted in the circuit breaker.

Preferably, the trip interlock assembly of the present invention is used in conjunction with an electronic tripping mechanism which is interconnected in a three phase electrical circuit and which houses at least three current transformers which sense an overcurrent condition and which provide a signal to the electronic circuitry within the modular housing of the electronic tripping mechanism to cause the main contacts of all three poles to be separated.

Preferably, the slider member of the present invention is disposed between at least two of the transformer units of the three phase electrical circuit and adjacent to the rotatable trip bar in the modular housing. This positioning of the slider member provides a barrier between the two neighboring transformer units and replaces the barrier of the prior art.

Preferably, the tripping mechanism in which the present invention is employed provides a manual mode of tripping the circuit breaker by depressing a push button located on front of the modular housing. When the button is operated, a mechanical device associated with the button and the trip bar rotates the trip bar which forces the catching member of the latching assembly downwardly to release the operating mechanism to trip the circuit breaker.

Preferably, the trip interlock assembly of the present invention is comprised of a slider member, a coil spring for biasing the slider member, and an actuator pivotally connected to the slider member; and preferably, the slider member with the coil spring is mounted in an underside of a cover of the housing of the modular trip unit.

It is, therefore, an object of the present invention to provide a tripping mechanism for a circuit breaker which is automatically activated when the circuit breaker is being removed from its panel mounting.

It is a further object of the present invention to provide a trip interlock assembly for automatically tripping a circuit breaker which operates in conjunction with some components of present-day electronic tripping mechanisms.

A further object of the present invention is to provide an integrally constructed mechanical trip interlock assembly in a modular trip unit which is simple in design with a minimum number of components and which provides a safety feature with regard to the current transformer units within the trip unit.

A still further object of the present invention is to provide a trip interlock assembly which automatically operates an electronic tripping mechanism and which has a slider which functions as a barrier to insulate two neighboring current transformer units.

A still further object of the present invention is to provide a trip interlock assembly which is constructed integrally within a modular trip unit for a circuit breaker.

These and other objects of the present invention will be fully understood and appreciated from the following description of the present invention upon reference to the illustrations appended hereto.

DESCRIPTION OF THE PREFERRED EMBODIMENT

Figure 1:
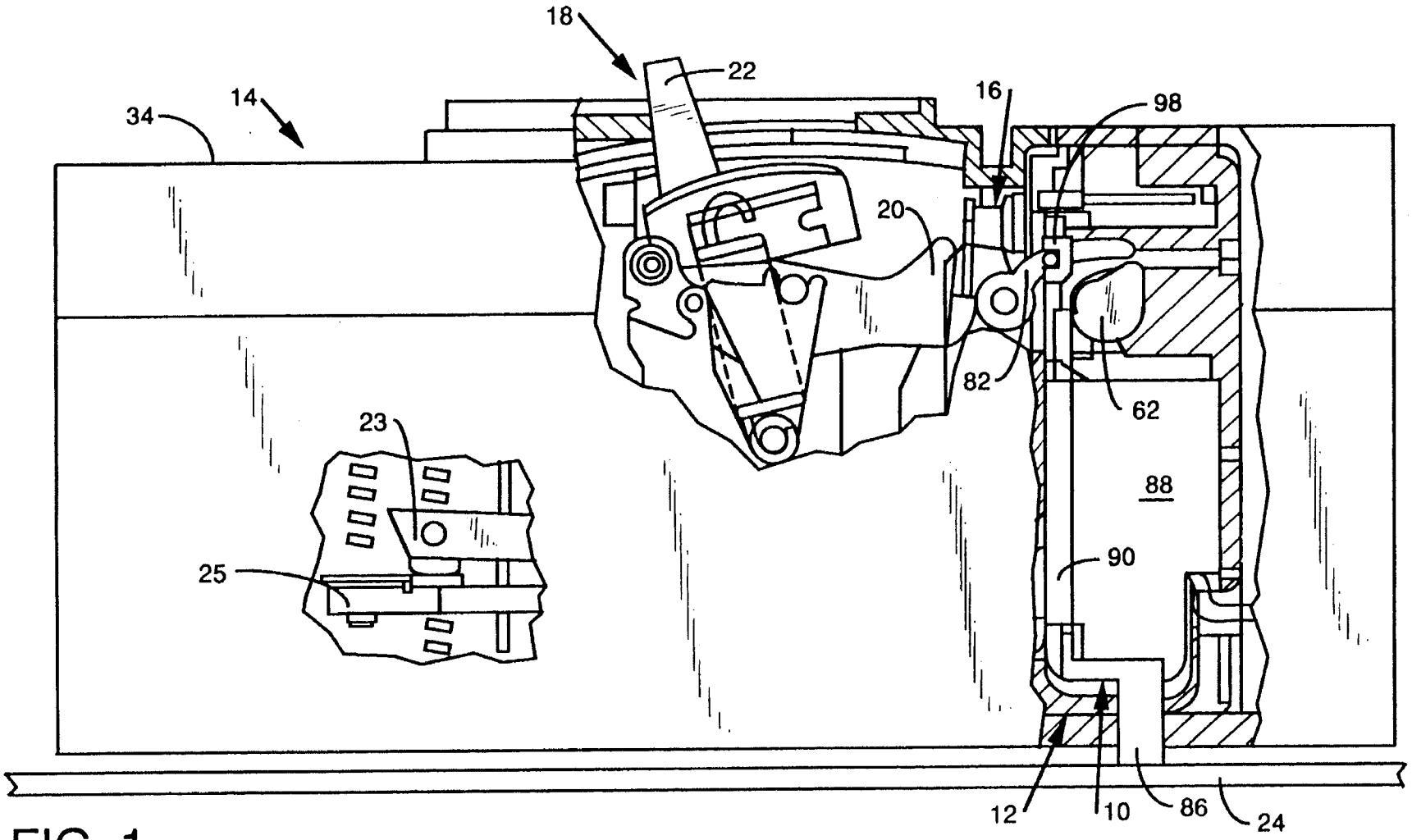
FIG. 1 is a side elevational, partly broken away, view showing the trip interlock assembly of the present invention and its positioning when the circuit breaker is mounted on a panel mounting.

In the Figures, the trip interlock assembly in accordance with the present invention is generally identified with the reference numeral 10.

Figure 2:
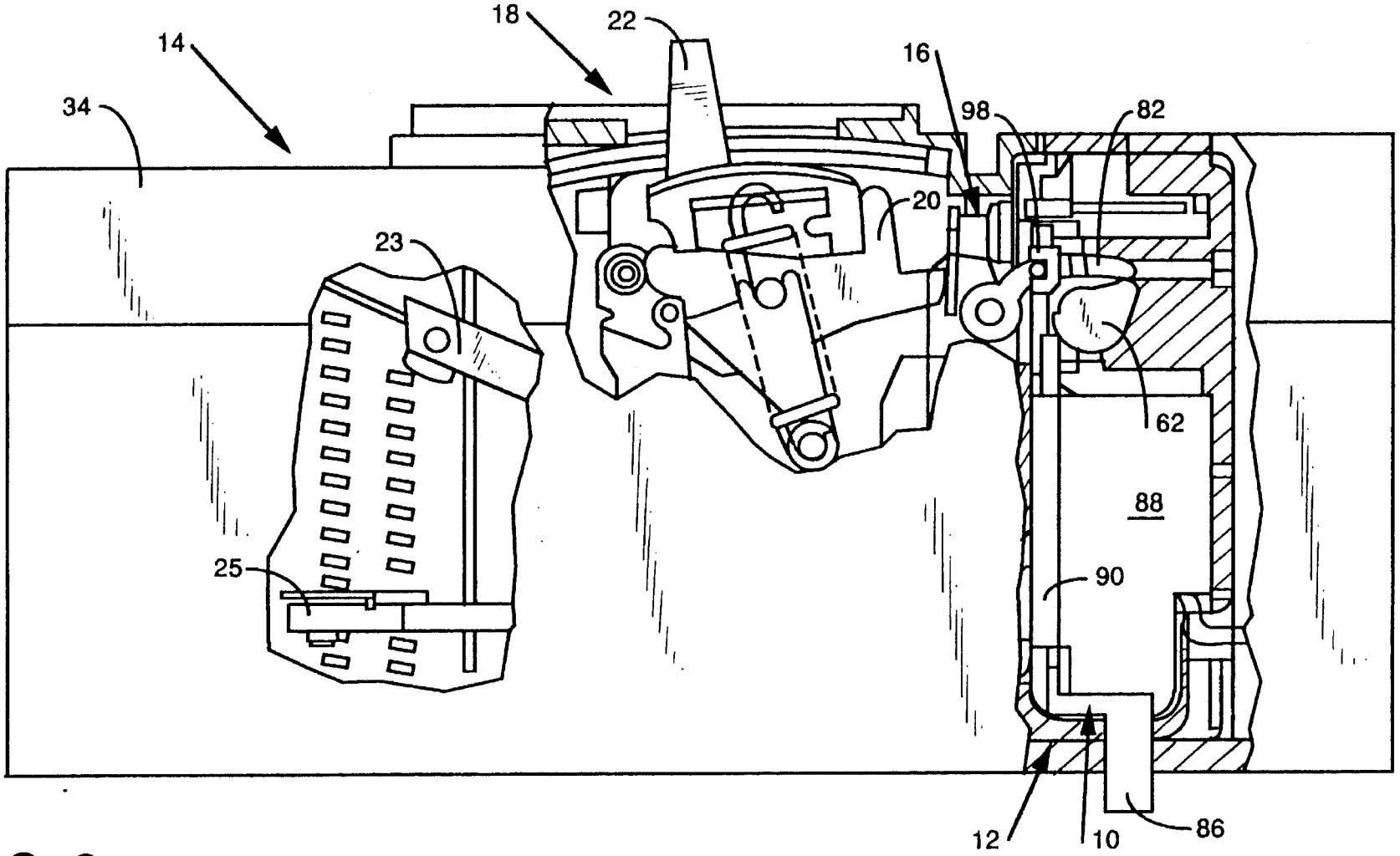
FIG. 2 is a side elevational, partly broken away, view showing the trip interlock assembly of the present invention and its positioning when the circuit breaker is being dismounted from the panel mounting.

Referring first to FIGS. 1 and 2, the trip interlock assembly 10 is mounted in a modular trip unit or tripping mechanism 12 which, in turn, is mounted in a circuit breaker 14. In FIG. 1, a latching assembly 16 engages a circuit breaker operating mechanism 18 to allow the current to flow through the circuit breaker 14. In FIG. 2, the latching assembly 16 is disengaged from the operating mechanism 18 whereby the current's flow is interrupted from the circuit breaker 14, more about which will be discussed hereinbelow.

The operation and function of tripping mechanism 12 (excluding the trip interlock assembly 10 of the invention), latching mechanism 16, and operating mechanism 18 are well-known to those skilled in the art and may be similar to those disclosed in the circuit breakers U.S. Pat. Nos. 4,489,295; 4,638,277; 4,642,430; 4,656,444; 4,679,018; 4,691,182; 4,698,606; 4,725,800; and 4,963,846, some of which patents have been discussed hereinabove.

Still referring to FIGS. 1 and 2, the operating mechanism 18 generally includes a cradle 20 which is latched to latching device 16, a handle 22 pivotally connected to cradle 20, and an overcenter toggle mechanism (not shown) associated with cradle 20 and handle 22 in a manner well-known in the art, and found in any of the aforementioned patents. The toggle mechanism is, in turn, operatively coupled to one or more pairs of separable main contacts 23 and 25.

When the circuit breaker 14 is removed from its panel mounting indicated at 24 in FIG. 1, the trip interlock assembly 10 will actuate the modular trip unit 12 which will cause the latch assembly 16 to unlatch cradle 20 of the operating mechanism 18 which, in turn, causes the overcenter toggle mechanism to collapse and separate the main contact 23 and 25 to interrupt the flow of current through circuit breaker 14 as shown in FIG. 2.

The principles of the present invention are equally applicable to various types of tripping means, but preferably, is used in connection with an electronic type of modular trip unit 12 known to those skilled in the art.

FIGS. 3, 4, 5 and 6 particularly illustrate such an electronic type of modular trip unit 12. Particularly referring to FIG. 3, trip unit 12 is comprised of heavy plastic molded cover 26 and base 28 with latching assembly 16 being secured to cover 26.

Preferably, the circuit breaker 14 of FIGS. 1 and 2 is interconnected in a three phase electrical circuit with a line side and a load side.

Figure 3:
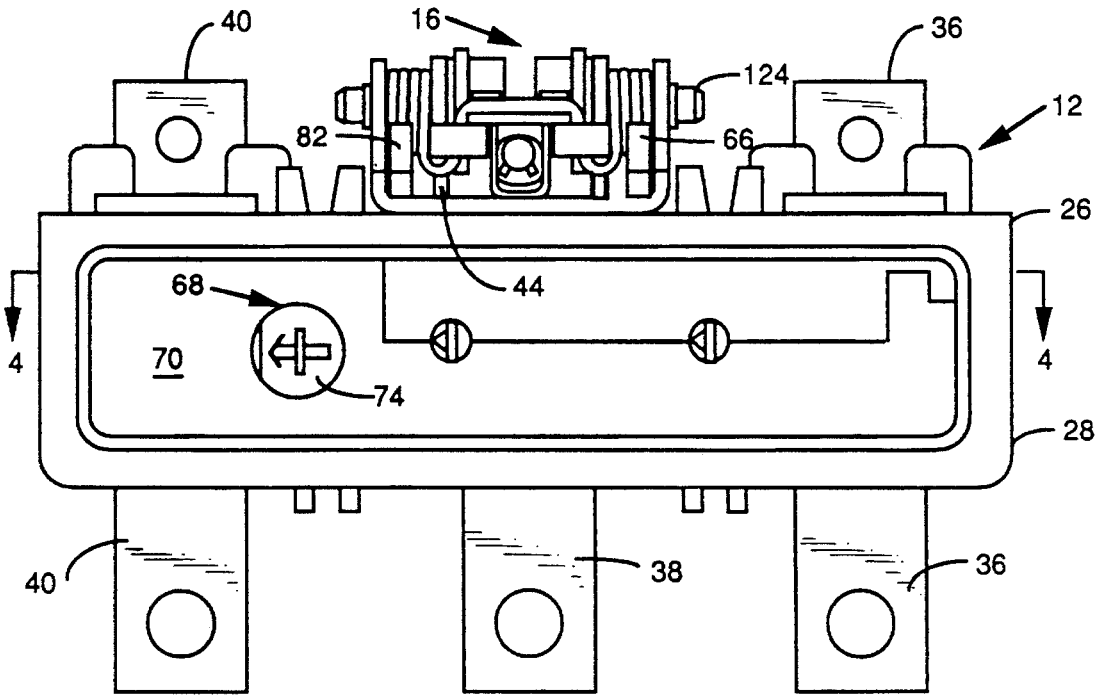
FIG. 3 is a side elevational view of the modular trip unit of FIGS. 1 and 2 in which the invention is utilized.
Figure 4:
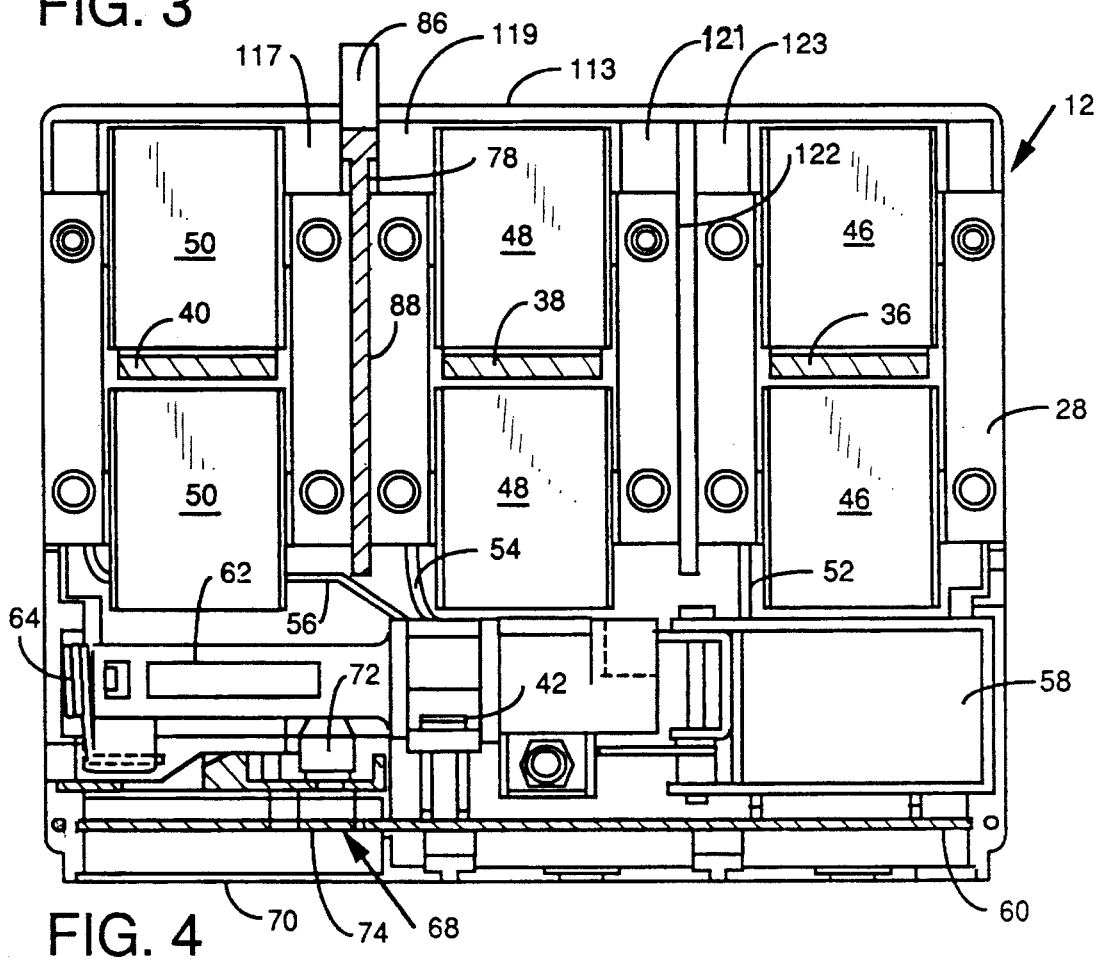
FIG. 4 is a plan view taken along lines 4—4 of FIG. 3 with a cover of the modular trip unit removed.

When electronic modular trip unit 12 is carried by the housing 34 of circuit breaker 14 of FIGS. 1 and 2, the circuit breaker 14 is connected to the line side and the load side by way of terminals 36, 38 and 40 shown in FIGS. 3 and 4. Each terminal 36, 38, and 40 is provided for each phase and is part of a circuit transformer assembly indicated at numerals 46, 48, and 50 in FIG. 4. These terminals 36, 38, and 40 and transformer units 46, 48, and 50 of FIGS. 3 and 4, are used to electrically connect trip unit 12 to the circuit breaker 14, which, in turn, is electrically connected into a three phase electrical circuit for protecting a three phase electrical system.

These current transformer units 46, 48, and 50 of FIG. 4 are electronically connected by electrical connection lines 52, 54, and 56, respectively, to an electronic circuitry consisting of solenoid 58 and circuit board 60, in a manner well-known in the art.

For an automatic tripping of the trip mechanism 12 due to an overcurrent in the system, the transformer units 46, 48, and 50 sense the overcurrent and provide a signal to the electronic circuitry, and solenoid 58 through a rod and spring arrangement (not shown) causes rotation of trip bar 62 which is biased in base 28 by a spring indicated at 64 to the left in FIG. 4. Trip bar 62 has a lip member 42 (FIG. 4) which engages a catching member 44 of latching assembly 16 when trip bar 62 is rotated.

As best shown in FIG. 4, trip bar 62 has several cam surfaces and configurations along its length in addition to lip member 42. When solenoid 58 is activated to rotate trip bar 62, an appropriate cam surface of trip bar 62 contacts a catching member 44 shown in FIGS. 3 and 6. This rotation of trip bar 62 causes catching member 44 of latching assembly 16 downwardly to disengage from lip member 42 shown in FIG. 4 of trip bar 62 to cause cradle 20 of FIG. 2 to become disengaged from latching assembly 16, resulting in the separation of contacts 23 and 25 according to the usual operation of these components of the prior art.

For a manual mode of operation of trip modular unit 12, and referring to FIGS. 3 and 4, a push button mechanism 68 is provided in a front wall 70 of base 28 of the trip unit 12. This pushbutton mechanism 68 is comprised of a cylindrical member indicated at 72 in FIG. 4 which houses a second plunger member (not shown) connected to pushbutton 74. When pushbutton 74 is either pushed or rotated by a workman, prior to the circuit breaker being removed from mounting 24 of FIGS. 1 and 2, the second plunger member (not shown) housed in cylindrical member 72 of pushbutton mechanism 68 is pushed inwardly against trip bar 62, causing trip bar 62 to rotate and lip member 42 to become disengaged from catching member 44 of latching assembly 16, and latching assembly 16 to release cradle 20 of operating mechanism 18 as shown in FIG. 2.

The above principles, operation, and features of the components of FIGS. 1, 2, 3, and 4 as explained hereinabove are well-known in the art. The trip interlock assembly 10 of FIGS. 1 and 2, will now be explained and described with particular reference to FIGS. 5, 6, 7, and 8.

Figure 5:
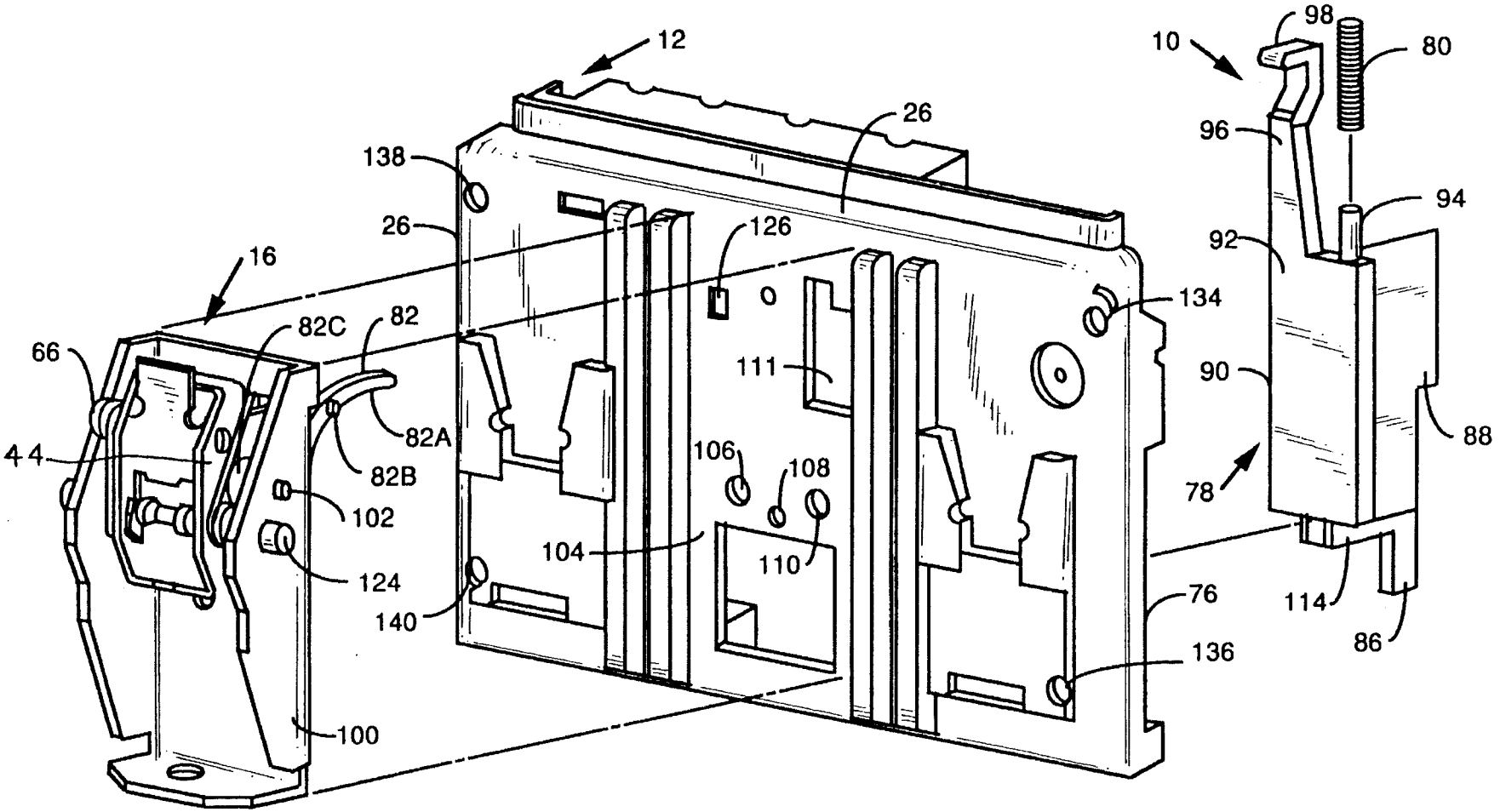
FIG. 5 is a perspective, exploded view showing the essential components of the trip interlock assembly of the present invention and its mounting in the cover of the modular trip unit of FIG. 3.
Figure 6:
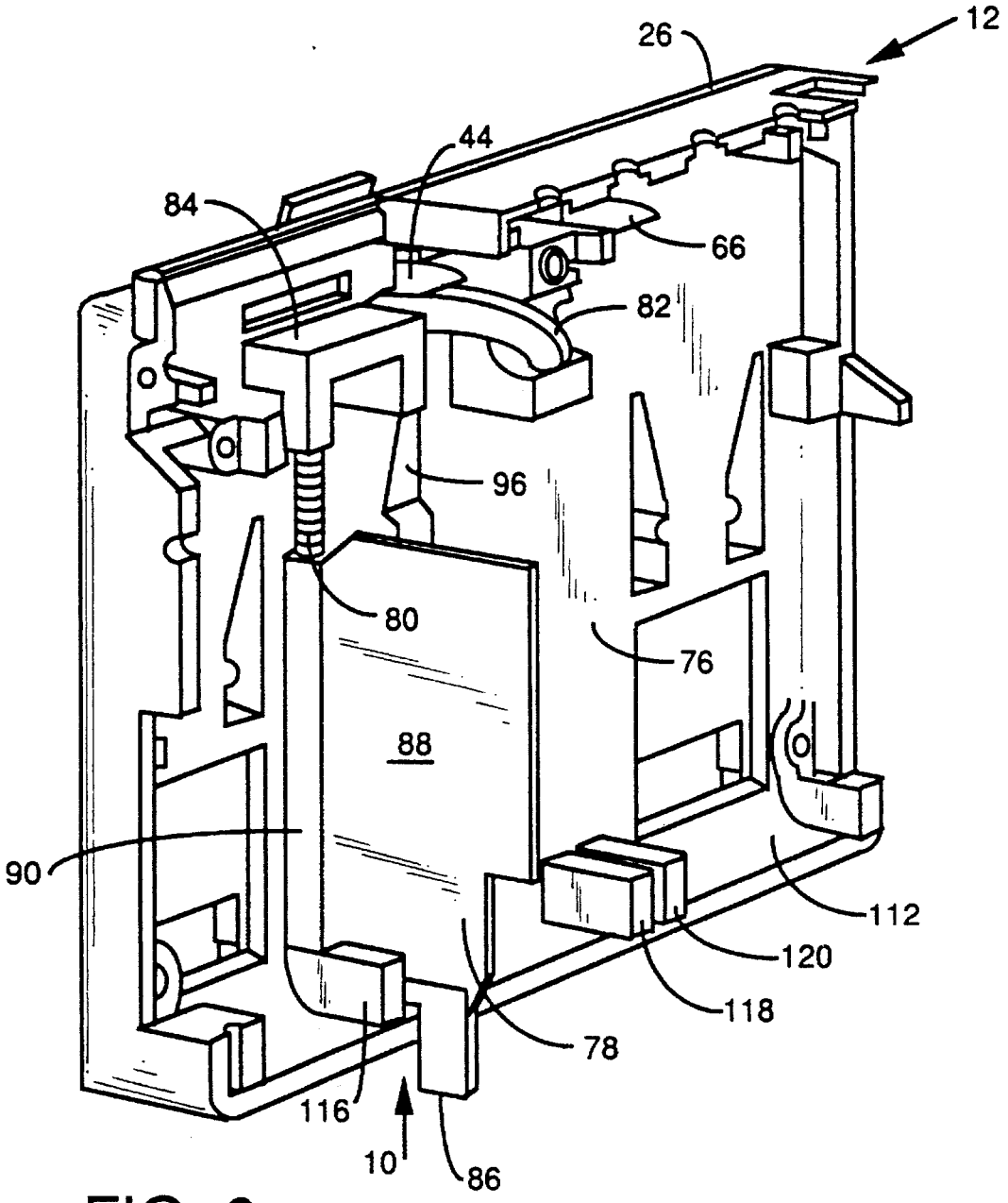
FIG. 6 is a perspective view illustrating the assemblage of the trip interlock assembly of the present invention mounted in the cover of the modular trip unit.

With reference to FIGS. 5 and 6, the trip interlock assembly 10 is mounted on the underside 76 of cover 26, and is comprised essentially of slider member 78, coil spring 80 carded by slider member 78, actuator 82, and slider pocket 84, shown only in FIG. 6. Slider pocket 84 in FIG. 6 is integrally formed on the underside 76 of cover 26 and receives coil spring 80.

Slider member 78, preferably, is a molded, integrally formed one-piece plastic member and has a probe 86 at its one end extending from a relatively thin partition or barrier 88. Probe 86 and barrier 88 are disposed generally in the middle of base 90 which has a generally flat surface 92 (FIG. 5) which lies against the underside surface 76 of cover 26, as shown in FIG. 6.

Barrier member 88 extends perpendicularly relative to the plane of base 90. As best shown in FIG. 5, extending from and in a parallel plane of base 90 on an end of slider member 78 is an elongated cylindrical member 94, and a finger member 96 spaced from elongated member 94 and extending in a same parallel plane as base 90. The distal end of finger member 96 has a hook or latch portion 98, shown best in FIGS. 5, 7, and 8.

As shown best in FIG. 5, coil spring 80 is disposed around cylindrical member 94. In FIG. 5, actuator 82 is shown as being pivotally mounted to bracket 100 of the latching mechanism 16 by a pivotal pin 102, which pin 102 is an integral part of actuator 82.

Figure 7:
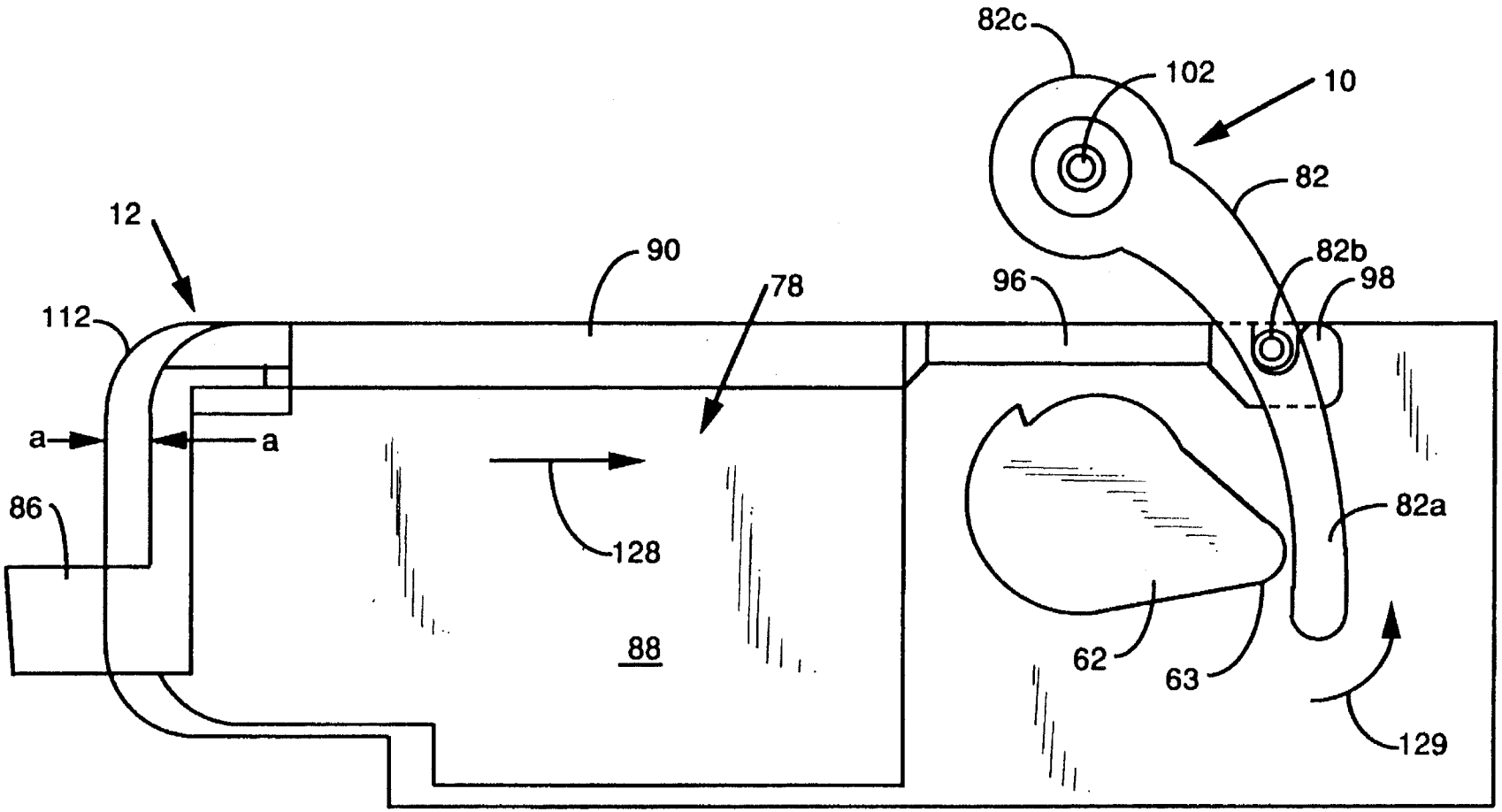
FIG. 7 is an enlarged schematic view of the trip interlock assembly of the present invention showing more clearly the components thereof and their positioning in the modular trip unit installed in the circuit breaker when the circuit breaker is mounted on a panel mounting similar to that of FIG. 1.
Figure 8:
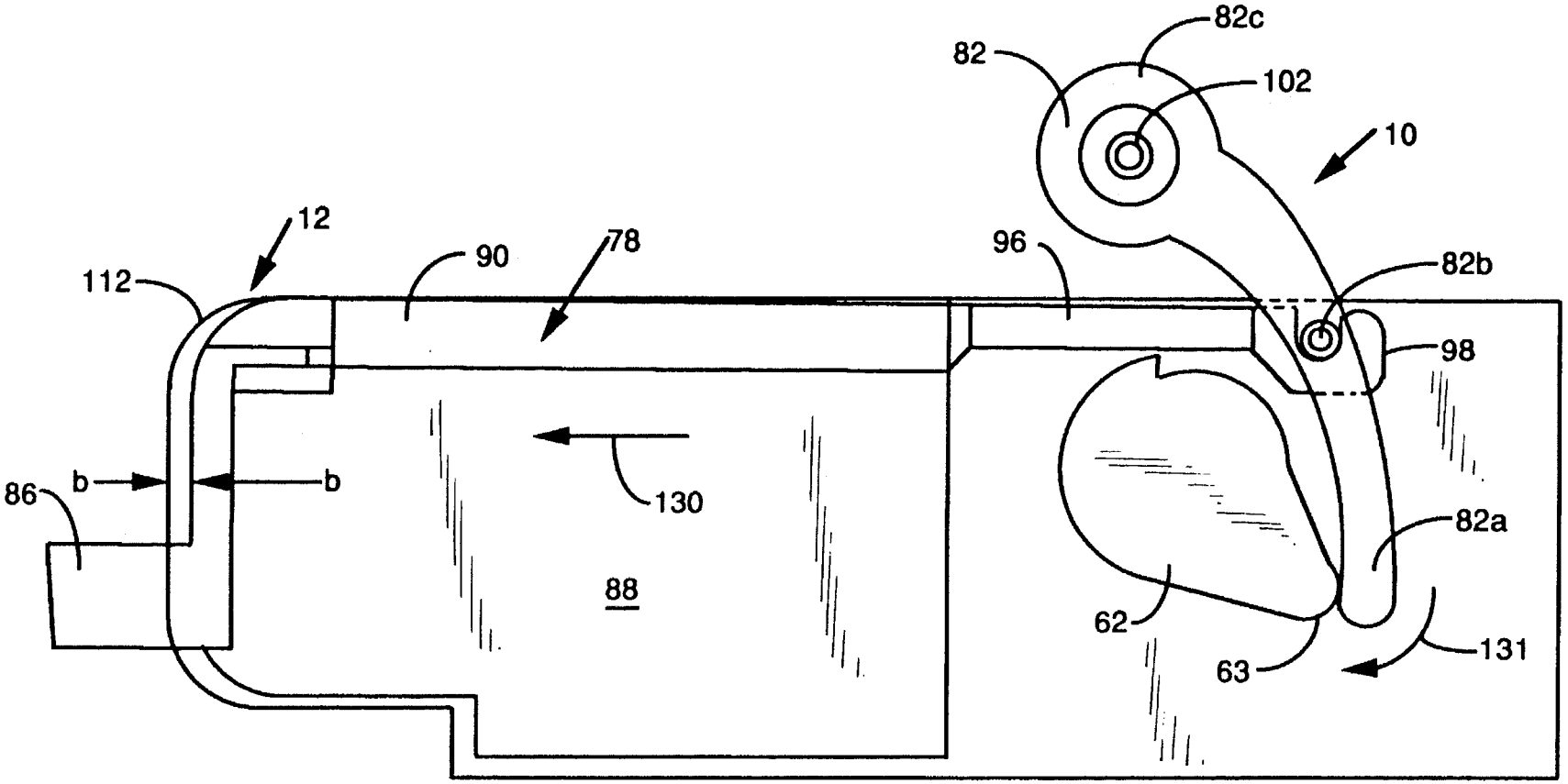
FIG. 8 is an enlarged schematic view of the trip interlock assembly of the present invention showing more clearly the components thereof and their positioning in the modular trip unit installed in the circuit breaker when the circuit breaker is being dismounted from the panel mounting similar to that of FIG. 2.

Actuator 82 as best shown in FIGS. 5, 7, and 8 has an arcuate finger 82*a*, a tab protrusion 82*b*, and a generally circular base 82*c* of which pivotal pin 102 is part of and which pin 102 is inserted on latching assembly 16 for mounting of actuator 82.

With reference to FIG. 5, latching assembly 16 is mounted to the outer surface 104 of cover 26 by fastening means received in apertures 106, 108, and 110 in a well-known manner. Also, actuator 82, along with catching member 44 of latching assembly 16, is received in opening 111 of cover 26 and extends therethrough as shown in FIG. 6, and down into base 28 of trip unit 12 when cover 26 and base 28 are in the assembled form of FIG. 3.

The trip interlock assembly 10 of the invention is installed and mounted in cover 26 as shown in FIG. 6. The hook portion 98 (FIG. 5) of finger 96 at the one end of slider member 78 engages tab 82*b* of actuator 82 as best shown in FIGS. 7 and 8, and coil spring 80, along with elongated member 94 of slider member 78, is held firmly in position in slider pocket 84 in cover 26 of FIG. 6. The other end of slider member 78 shown and indicated at 114 in FIG. 5 fits snugly between a pair of cooperative bracket members, one of which is indicated at numeral 116 in FIG. 6, with probe member 86 extending beyond the backwall 112 of cover 26. These bracket members 116, as well as the bracket pair of cooperative members 118 and 120, are integrally formed along the back wall 112 of cover 26. As shown in FIG. 4, similar pairs of cooperative bracket members 117, 119, 121 and 123 are provided in the back wall 113 of base 28 of trip unit 12 and cooperate with bracket members in cover 26 such as those indicated at numerals 116, 118 and 120 to receive barrier members 88 and 122 disposed between transformer units 46, 48 and 50 for isolation purposes. Barrier member 122 can essentially be a piece of cardboard, and, preferably, is still used in conjunction with the present invention for isolating transformer 46 from transformer 48.

However, in view of the present invention this type of barrier member 122 is no longer needed between transformer units 48 and 50 as shown in FIG. 4 in view of barrier 88 of the trip interlock assembly 10 of the invention. Slider member 78 is disposed between units 48 and 50 such that barrier member 88 replaces the conventional type of barrier means 122 previously disposed between transformers 48 and 50.

Referring again to FIGS. 3 and 5, and latching assembly 16, it is to be noted that plunger member 66 mounted on shaft 124 is received in opening 126 of cover 26, and extends alongside actuator 82 so that when cover 26 and base 28 of FIG. 3 are assembled, both actuator 82 and plunger member 66 come into contact with a different cam surface of trip bar 62 of FIG. 4, in a usual manner for plunger member 66 in prior art designs.

When trip unit 12 of FIGS. 3, 4, 5, and 6 is carried by the circuit breaker 14 shown in FIGS. 1 and 2, and when circuit breaker 14 is mounted on its panel mounting 24 of FIGS. 1 and 2, probe 86 of trip interlock assembly 10 is pressed against panel mounting 24 causing slider member 78 with finger 96 to slide inwardly inside trip unit 12 as indicated by the arrow at 128 in FIG. 7 and causing coil spring 80 to become compressed. This action also causes finger 96 to rotate actuator 82 in a direction indicated by the arrow at 129 with respect to FIG. 7, so that finger 82*a* of actuator 82 is spaced away from the cam surface 63 of trip bar 62 in the manner shown in FIGS. 1 and 7. The distance between slider member 78 and backwalls 112 and 113 of cover 26 and base 28, respectively represented schematically in FIG. 7, is indicated at a—a.

When circuit breaker 14 is pulled away from its panel mounting 24 for any reason, compressed coil spring 80 of the trip interlock assembly 10, expands thereby sliding slider member 78 in a direction indicated by arrow 130 of FIG. 8, and causing probe member 86 to extend farther out of the backwalls 112 and 113 of trip unit 12. This distance traveled by slider member 78 is indicated at b—b in FIG. 8, and is less than the distance a—a in FIG. 7. This sliding movement of slider member 78 causes finger 96 of slider member 78 to rotate actuator 82 in a direction indicated by the arrow at 131 with respect to FIG. 8. Finger 82*a* of actuator 82 makes contact with cam surface 63 of trip bar 62 with a sufficient force as to contact and rotate trip bar 62 in the direction of arrow 131. This, in effect, causes the lip member 42 on trip bar 62 to free catching member 44 of latching assembly 16 (FIGS. 4 and 6) to allow catching member 44 to move downwardly so as to release cradle 20 from latch assembly 16. The center toggle mechanism is activated to separate main contacts 23 and 25 in a manner well-known in the art and discussed hereinabove with reference to FIGS. 1 and 2.

It is to be noted that in the usual fashion, and in referring particularly to FIG. 5, cover 26 is securely fastened to base 28 (FIGS. 1 and 2) by fastening means (not shown) received in apertures 134, 136, 138, and 140 located at the corners of cover 26. It is to be further noted that both cover 26 and base 28 form a modular housing for trip unit 12 and that both cover 26 and 28 have an opening in their respective backwalls 112 and 113 such that when cover 26 and base 28 are assembled, the respective openings cooperate to form an aperture (not shown) for receiving probe 86 of slider member 78 (FIG. 4).

Whereas, particular embodiments of the invention have been described above for purposes of illustration, it will be appreciated by those skilled in the art that numerous variations of the details may be made without departing from the invention as described in the appended claims.

In accordance with the provisions of the patent statutes, we have explained the principles and operation of our invention and have illustrated and described what we consider to be the best embodiments thereof.

What is claimed:

1. A modular trip unit mounted in a circuit breaker for interrupting the flow of current through said circuit breaker by operation of an operating mechanism for said circuit breaker, said modular trip unit comprising;

a modular housing, a latching assembly mounted on said modular housing for operation of said operating mechanism for said interrupting of said flow of current through said circuit breaker, rotatable trip bar means in said modular housing for activating said latching assembly, a trip interlock assembly mounted in said modular housing, said trip interlock assembly, comprising:

a pivotally mounted actuator in contact with said trip bar means, reciprocating means interconnected with said actuator for imparting a first and a second pivotal movement to said actuator, and means for sliding said reciprocating means in said housing, such that a first sliding movement of said reciprocating means biases said reciprocating means for said imparting of said first pivotal movement to said actuator, and such that a second sliding movement of said reciprocating means unbiases said reciprocating means for said imparting of said second pivotal movement to said actuator for rotating said trip bar means for causing said activation of said latch assembly by said trip bar means, and therefore, said activation of said operating mechanism for said interruption of said flow of current through said circuit breaker.

2. A modular trip unit of claim 1, wherein said reciprocating means is a slider element, and wherein said means for sliding said reciprocating means includes a probe extension on said slider dement projecting from said housing for contact with an external support surface.

3. A modular trip unit of claim 1, wherein said actuator is pivotally mounted to said latching assembly which is mounted on the outside of said modular housing and includes a portion which extends through an opening in said modular housing.

4. A modular trip unit of claim 1, wherein said trip bar means has a first cam surface means in contact with said actuator and a second cam surface means.

5. A modular trip unit of claim 4, wherein said latching assembly includes means in association with said second cam surface means of said trip bar means for said activating of said latching assembly upon said rotation of said trip bar means by said actuator of said trip interlock assembly.

6. A modular trip unit of claim 1, wherein said reciprocating means comprises barrier means for compartmentalizing said modular housing.

7. A modular trip unit of claim 1, further comprising means in said modular housing for receiving and movably mounting a first end of said reciprocating means in said modular housing.

8. A modular trip unit of claim 7, wherein said modular housing comprises a base and a cover, and wherein said reciprocating means is mounted in said cover and wherein said actuator is mounted outside said cover and includes a portion which extends down into said cover.

9. A modular trip unit of claim 1, wherein said reciprocating means further comprises a slider element having a first end movably mounted in said modular housing, and a second end movably mounted in said modular housing and including a probe extending out of said modular housing for said imparting of said first sliding movement to said reciprocating means.

10. A modular trip unit of claim 1, wherein said actuator has an arcuate configuration.

11. A modular trip unit of claim 1, wherein said actuator includes tab means, and wherein said reciprocating means includes a hook portion in engagement with said tab means of said actuator.

12. A modular trip unit of claim 1, wherein said means for sliding said reciprocating means further includes a coil spring, and wherein said reciprocating means further comprises:

a base portion, a barrier portion extending upwardly from said base portion for compartmentalizing said modular housing, a probe member extending outwardly from said barrier portion for enabling said first and said second sliding movement of said reciprocating means, an elongated member extending generally from and contiguous to said base portion for carrying said coil spring, and a finger element contiguous to said base portion and extending generally parallel to said elongated member and in engagement with said actuator.

13. A trip interlock assembly in association with a trip bar means for operating an operating mechanism of a circuit breaker mountable on a panel mounting to cause the flow of current through said circuit breaker to be interrupted, comprising:

a pivotally mounted actuator in contact with said trip bar means, reciprocating means interconnected with said actuator for imparting a first and a second pivotal movement to said actuator, and means for sliding said reciprocating means such that when said circuit breaker is being mounted onto said panel mounting, a first sliding movement of said reciprocating means biases said reciprocating means for said imparting of said first pivotal movement of said actuator, and such that when said circuit breaker is removed from said panel mounting, a second sliding movement of said reciprocating means unbiases said reciprocating means for said imparting of said second pivotal movement to said actuator for rotating said trip bar means for said operating of said operating mechanism and said interruption of said flow of current through said circuit breaker.

14. A trip interlock assembly of claim 13, wherein said reciprocating means is a slider element, and wherein said means for sliding said reciprocating means includes a probe extension on said slider element projecting from said circuit breaker for contact with said panel mounting.

15. A trip interlock assembly of claim 13, wherein said trip bar means has a first cam surface in contact with said actuator.

16. A trip interlock assembly of claim 13, wherein said reciprocating means comprises barrier means for compartmentalizing a portion of said circuit breaker.

17. A trip interlock assembly of claim 13, wherein said actuator has an arcuate configuration.

18. A trip interlock assembly of claim 13, wherein said actuator includes tab means, and wherein said reciprocating means includes a hook portion in engagement with said tab means of said actuator.

19. A trip interlock assembly of claim 13, wherein said means for sliding said reciprocating means further includes a coil spring, and wherein said reciprocating means further comprises:

a base portion, a barrier portion extending upwardly from said barrier portion for enabling said first and said second sliding movement of said reciprocating means, an elongated member extending generally from said base portion for carrying said coil spring, and a finger element contiguous to said base portion and extending generally parallel to said elongated member and in engagement with said actuator.

* * * * *